United States Patent [19]

Goldberg et al.

[11] 4,097,051

[45] Jun. 27, 1978

[54] BOARD GAME APPARATUS

[76] Inventors: Robert M. Goldberg, 1321 Dutch Broadway; John R. O'Connor, 74 Jackson Rd., both of Valley Stream, N.Y. 11581

[21] Appl. No.: 740,809

[22] Filed: Nov. 11, 1976

[51] Int. Cl.[2] ..... A63F 3/04

[52] U.S. Cl. ..... 273/254; 273/243

[58] Field of Search ..... 273/134 AC, 134 AA, 273/134 AD, 134 C, 134 D

[56] References Cited

U.S. PATENT DOCUMENTS

| | | | |
|---|---|---|---|
| 1,346,826 | 7/1920 | Huggins | 273/134 AC |
| 1,653,464 | 12/1927 | Lomas | 273/134 AC |
| 2,273,292 | 2/1942 | Smith | 273/134 AT |
| 3,951,411 | 4/1976 | Hill et al. | 273/134 C |
| 4,000,897 | 1/1977 | York | 273/134 D |
| 4,016,939 | 4/1977 | Thron | 273/134 AT |

FOREIGN PATENT DOCUMENTS

| | | | |
|---|---|---|---|
| 979,214 | 1/1965 | United Kingdom | 273/134 AC |
| 609,218 | 9/1948 | United Kingdom | 273/134 AT |

OTHER PUBLICATIONS

"Wide World Travel Game", *This Week Magazine*, Wash. D. C. Sunday Star, Dec. 30, 1956, pp. 8, 9, 14.

*Primary Examiner*—Robert W. Michell
*Assistant Examiner*—Arthur S. Rose
*Attorney, Agent, or Firm*—Brumbaugh, Graves, Donohue & Raymond

[57] ABSTRACT

A board game for two or more players combines elements of strategy, knowledge of geography and chance in simulating the action of intelligence agents in performing assigned missions. The board surface is an unlegended map of the principal part of the world with unidentified target sites designated thereon. The map is marked with latitude parallels and longitude meridians at small intervals, e.g., 10°, the intersections forming a grid of spaces along which the playing pieces move. Random drawing of secret mission cards by each player assigns particular target sites to be reached by each player and the particular missions to be performed at the sites. The object of the game is to move the playing pieces to the assigned target sites by roll of dice, carry out the designated mission, and, if required, return to the starting point, at the same time trying to impede the progress of the other players. Forbidden and Danger Zones are designated on the map to further impede movement of the playing pieces and contribute to the importance of strategy in play.

9 Claims, 8 Drawing Figures

A-40
MISSILE
One of the world's largest and most important cities. Famous for Red Square and the Tomb of Lenin. Capital of the country with the largest standing army in the world, and a leader in space exploration.
22
FIG. 2A
FIG. 2B
A-7
DOCUMENTS
Chinese city; near the Great Wall; seat of Communist government.
24
DANGER ZONE
HURRICANE
GULF OF MEXICO
From 20° to 30°N
85° to 95°W
26
FIG. 3
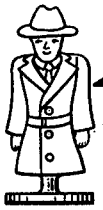
30
FIG. 4A
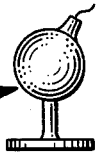
32
FIG. 4B
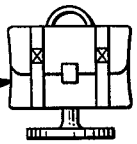
34
FIG. 4C
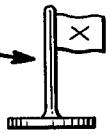
36
FIG. 4D

BOARD GAME APPARATUS

This invention relates to board games, and more particularly to the apparatus for such a game which combines the elements of strategic skill, chance and knowledge of geography to provide an entertaining diversion for two or more players.

The game is based on the simulation of the action of intelligence agents in carrying out assigned missions, while at the same time, trying to impede or block the ability of other "unfriendly" intelligence agents to carry out their assigned missions. The area of play imprinted on the board is a geographic map, preferably a map of substantially the entire world, divided by latitude parallels and longitude meridians into a grid of spaces, and marked with a plurality of indicia designating target sites. The map itself is unlegended and the target sites unidentified except as might be apparent from the latitudes and longitudes of their locations. The other principal elements of the game are one or more sets of Mission cards bearing clues of varying difficulty which identify the target sites, a set of Danger Zone cards designating areas through which players may not pass, playing pieces for movement by each of the players and a pair of dice for governing the movement of the playing pieces across the board.

Play of the game may be briefly summarized as follows. At the commencement of play, each player is dealt or randomly draws, a plurality of Mission cards and a number of Danger Zone cards. Each of the Mission cards bears a clue to the location of a target site marked upon the board map and an indication of the nature of the mission to be performed at the target site. The latter may be, for example, the destruction of a missile complex located at the target site or the pick-up of secret documents at the target site and the return to the starting point. Preferably, each player has missions of both types to perform.

Starting points for each of the players are located in prescribed safety zones located at the extremities of the map and movement of each player is governed by a roll of the dice. The order of play may be governed by roll of the dice or other random selection.

Each player is provided with a plurality of playing pieces sufficient for the number of missions he has performed. For each roll of the dice, the player moves one or two of his playing pieces a number of spaces formed by the intersecting latitude and longitude lines equal to the number of spots on the uppermost faces of the dice, the object being to get his playing pieces to his assigned target sites as quickly as possible.

Upon reaching a target site, the player announces that he has reached his target site and turns over his Mission card for verification. He then attempts to complete his mission by roll of the dice and, if required by the nature of the mission, return his playing piece to his starting point. The first player to complete all of his assigned missions is the winner of the game.

As will be explained more fully below, various impediments to movement of the playing pieces are provided on the board map itself and strategems are available to the players for impeding the progress of the others. Auxiliary identification means are provided by which, for a penalty, a player may fully identify an assigned target site that he was not able to identify by the clue given on the Mission card.

The game is capable of a wide range of variations in play and the format of the board and of the other game elements may be widely varied, as will become apparent from the following detailed description of a preferred embodiment, taken in conjunction with the accompanying drawings, in which:

FIGS. 2A and 2B are samples of the Mission cards distributed to the players;

FIG. 3 is a sample of the Danger Zone cards distributed to the players; and

Figure 1:
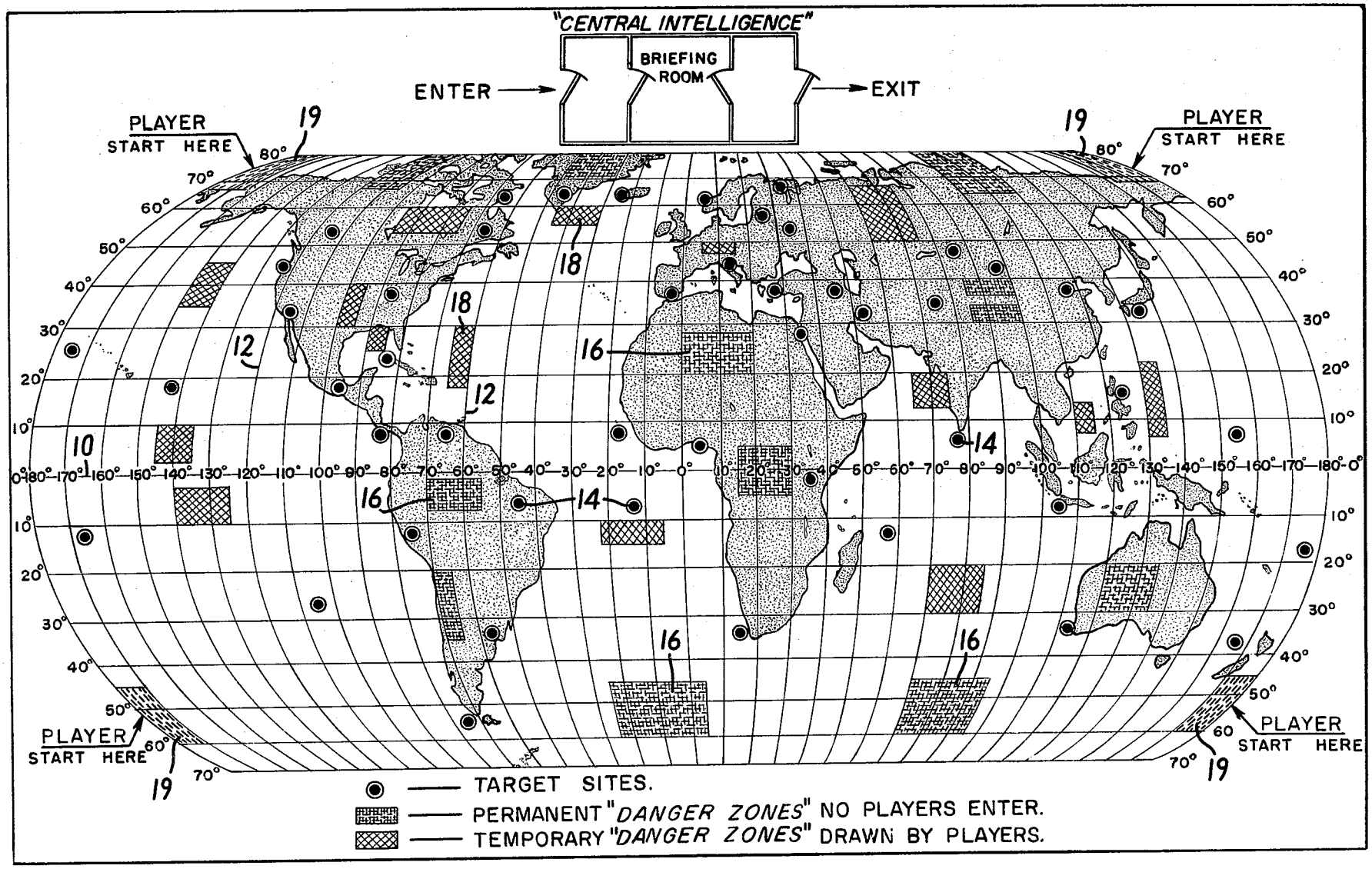
FIG. 1 illustrates the board with the playing surface in the form of a map of substantially the entire world.

FIGS. 4A – D illustrate playing pieces employed during play of the game.

DETAILED DESCRIPTION OF PREFERRED EMBODIMENT

The four principal components of the game are (1) the game board; (2) the Mission cards; (3) the Danger Zone cards; and (4) the playing pieces. Each of the four components will be described in detail below, followed by a description of the manner of play and the rules governing a preferred form of the game. Ordinary dice may be used to govern movement of the playing pieces.

In addition to the four above-noted components, there will also be a Master List, identifying all of the target sites noted on the board and keyed to the Mission cards distributed to the players, to be used in the event a player is unable to identify his target site from the clue on the Mission card and to verify the accuracy of a player's identification of a target site.

THE GAME BOARD

The preferred format of the game board is shown in FIG. 1. As illustrated, the board consists of a projection of a map of the world, eliminating such areas as the Arctic and Antarctic continents. Thus the map as illustrated, covers all of the earth's surface between 60° south latitude and 75° north latitude. The prime meridian, 0°, is at the center of the map and the right and lefthand edges are dual representations of the 180° meridian.

The map is divided into a grid of spaces by the intersection of latitude parallels 10 and longitude meridians 12. Preferably, both the latitude and longitudinal lines are spaced at 5° or 10° intervals, although larger spacings may be used to simplify play of the game. Legends identifying the latitude and longitude lines are included along the edges of the map.

The map itself is geographic, rather than political, that is, land masses and water masses are indicated, but national boundaries are not. Moreover, no legending of the map area is included, other than latitude and longitude degree markings. These omissions contribute to the skill required for play of the game by calling on the players' knowledge of geography.

A plurality of easily discernible indicia 14, such as a heavy dot within a circle, are imprinted at predetermined locations on the map surface. These indicia designate the target sites, actual cities or other strategic places, and are accurately located at the latitude and longitude of those locations. Also imprinted on the board map are a number of Forbidden Zones 16 and Danger Zones 18, indicated in FIG. 1 by different cross-hatching. In the commercial version of the board, these zones may be indicated by different colors, e.g., red for the Forbidden Zones 16 and blue for the Danger Zones 18. The Forbidden Zones 16 represent those areas of the globe which correspond to virtually impassable area, such as the Sahara Desert in Africa and the Amazon Rain Forest in Brazil and, in the game, are forbidden to entry by any player. In other words, no player of the game may move his playing piece through any of the Forbidden Zones 16.

The Danger Zones represent areas of the earth in which conditions obtain from time to time that render passage difficult or dangerous. Thus, the Danger Zones 18 would include the hurricane belt in the Caribbean Sea, the floating iceberg area off the Greenland coast, the tornado belt in the central United States, etc. As will be explained below, danger zones are allotted by chance to the players and represent areas which are forbidden only to the player to whom they are allotted.

Also imprinted on the game board is a three-section area designated as "Central Intelligence." This area is employed in those instances where a player is unable to determine a target site assigned to him from the clue on the corresponding Mission card and has to resort to the Master List, as will be explained fully below.

Finally, the starting points for each of the players are provided in designated Safety Zone areas 19 located in each of the four "corners" of the map. When more than four players are in the game, more than one player may begin movement of his playing pieces from the same starting area. Safety Zones are havens for the playing pieces of the players and players other than the one to whom a Safety Zone is assigned may not enter or pass through it at any time.

MISSION CARDS

In the illustrated embodiment, a total of 48 target sites are indicated. This provides a reasonable number for up to eight players, but more or fewer may be employed if desired. For each of the target sites, a Mission card of the type illustrated in FIG. 2, is provided. Each of the Mission cards includes an identification of the nature of the mission to be performed and the clue to the location of the target site at which the mission is to be performed. Thus, the Mission card 22 is designated "Missile", signifying that the mission is the destruction of a missile base at the indicated location. The designation "A-40" on the card 22 is an index number, the letter A signifying a specific set of Mission cards and the numeral indicating the number of the card within that set.

The Mission card 24 bears the mission designation "Documents", signifying that the mission of the agent is to retrieve a document located at the indicated site and return it to his starting point.

In a preferred mode of play, each player is dealt, or draws, five Mission cards; three missile and two document cards. However, this may be varied as desired to change the format of the game.

As indicated above, more than one set of Mission cards may be provided with each game. Thus, in addition to the A set, there may be B and C sets, each identifying the same 48 target sites, but with clues presenting differing degrees of difficulty. For example, target site 40 is identified in the Mission card of the A set as "One of the world's largest and most important cities. Famous for Red Square and the Tomb of Lenin. Capital of the country with the largest standing army in the world, and a leader in space exploration.", while the same target may be identified in the B set simply as "56° N. latitude, 38° E. longitude," and in the C set by the clue "Over 6,000,000 people in this city's metropolitan area. The Kremlin dominates this city. Capital of the largest country in the world. Historic home of the Czars." (All three clues, of course, identify the city of Moscow in the U.S.S.R.)

For use in assisting players who are unable to determine the identity of the target site from the clue on the Mission card, and to verify the identity of a target in case of dispute, a Master List of all of the target sites, by popular name and latitude and longitude locations is also provided. This list is keyed to the index numbers that appear on the Mission cards and is so arranged that upon referral to the Master List, only the specific target site in question is identified. For example, the Master List may consist of a set of cards bearing the numbers of the Mission cards on one surface and the identity of the target site on its opposite side so that when looking through the cards for a specific target site, the player does not see, inadvertently or otherwise, the designations of any of the other target sites. Alternatively, a double spool or scroll arrangement may be employed within a frame with all of the locations printed in sequential areas of a continuous strip. The frame may be provided with a viewing window through which the index number of each set of identifying data is visible as the advance spool is turned. When the designated index number appears in the window, advance of the spool is stopped and a door in the front of the frame opened to permit reading of the identifying data.

THE DANGER ZONE CARDS

The Danger Zone cards, one of which is illustrated at 26 in FIG. 3, are randomly dealt or selected by the players at the commencement of play and identify fully those Danger Zones on the map through which the designated player is forbidden to pass. Thus, the card 26 designates a hurricane area 18 (FIG. 1) in the Gulf of Mexico by its latitude and longitude boundaries, through which the player who draws that card may not pass. The card also specifies the nature of danger prevailing in that zone and thus serves to educate the player to natural forces and conditions which occur on the earth that represent danger to travel.

A total of 15 Danger Zones are delineated on the map. In the preferred mode of play, two cards for each zone are provided and each player is dealt or draws three. Two players may then be allotted the same Danger Zone and both would be unable to pass through it.

THE PLAYING PIECES

Each player is provided with a set of playing pieces, each set of which is identical in physical form to the others, but is distinguishable from all the others by an easily discernible characteristic, such as color. In each case, the playing pieces may be one to two inches in height and molded or otherwise formed from inexpensive materials such as plastic, wood or diecast metal. In the preferred form of the game, each set of playing pieces consists of 13 units, each of which is formed with a pedestal base enabling it to stand erect on the game board. The playing pieces of each set consist of the following:

1. Five identical "agent" pieces, such as in the form of a replica of a man dressed in characteristic trench coat and hat, for use during movement from the starting point to the target sites. An "agent" piece is illustrated by the numeral 30 in FIG. 4A.
2. Three missile destruction pieces, such as in the form of bombs, illustrated at 32 in FIG. 4B, also with bases enabling them to stand erect on the board surface. These pieces replace the agent pieces when the latter have reached a target site on a mission calling for destruction of the missile at the site and the player has so declared his mission.

3. Two document retrieval pieces, such as in the form of a briefcase mounted on a pedestal, illustrated at 34, FIG. 4C. These pieces replace the agent pieces when the latter reach target sites on a mission calling for retrieval and return of documents to the starting point.
4. Three danger zones flags on pedestals, numeral 36, FIG. 4D, for identifying the danger zones drawn by each player through which he is unable to pass.

THE PLAY OF THE GAME

Prior to commencement of play, the players roll dice to determine an order of play, the highest number being first, etc. The players then select their sets of playing pieces and their starting point Safety Zones. The players then are dealt, or draw, from the pack of Mission cards, face down, five Mission cards each. Preferably, the pack of Mission cards is separated into two piles; one of the Missile cards the other of the Document cards, and each player selects three Missile cards and two Document cards. These cards are kept face down by each player so that the other players will be unaware of his target sites.

Finally, the players draw or are dealt three Danger Zone cards which may then be turned up to inform all of the players of the respective Danger Zones of each. The Danger Zone flags of each player may then be placed in the respective Danger Zones.

At the start of play, each of the five agent pieces of each of the players is in the starting point Safety Zones 19 selected by the player. The players then commence rolling of the dice in the order initially established.

For each roll of the dice, a player is permitted to move (1) one agent the total number of spaces indicated by the upturned faces of the dice, or (2) move two agent pieces, each corresponding to the spots on the upturned face of one of the respective dice. In moving the agent pieces, the pieces may be moved East, West or North, South or a combination of the two, but no diagonal movement is permitted. Thus, if a player rolls a "nine," one "five" and one "four," he may move one of his agent pieces five spaces and another agent four spaces, or he may move one agent nine spaces. An agent may be moved in only two directions in any single turn. No backtracking during a move is permitted, that is, a player, during a single move may not move his piece both north and south or both east and west.

Since the right and left hand longitude lines on the board actually represent the same 180° longitude meridian, a player may move his piece across one edge and then continue movement inward on the board from the opposite edge.

Each player rolls the dice in turn with the objective eventually to get all of his agents to assigned target sites so that the designated missions may be carried out. During this movement, the players must avoid all of the Forbidden Zones as well as his own assigned Danger Zones.

In order to carry out the assigned mission at a target site, the player must land his piece on the target site, that is, the movement indicated by the roll of the dice must put the agent piece exactly on the target site space at the end of the count. At the whim or strategy of the player, he may move one piece continually toward a target site while leaving the remaining four at the starting point, or he may move some or all of the pieces in successive turns, in whatever combination he sees fit.

Upon landing on a target site, the player does not indicate that he has reached the target. On his next turn, he may or may not make the announcement, as he chooses. If he chooses to annouce that he has reached his assigned target site, he then turns over the corresponding Mission card for verification by the other players. At this point, the player may declare his intention to destroy the missile (if that is the nature of the mission) or to begin his return trip, if the mission is retrival and return of a secret document. In order to destroy a missile base, the player must roll a "seven" or "eleven" with the dice. After declaring that he has reached a target site, the player need not immediately attempt to destroy the missile site or begin a return trip with the secret documents. He may simply leave his agent on the target site and devote his succeeding turns with the dice to movement of other agents towards their respective target sites. However, a player who announces the intention to destroy a missile base, loses the right to move any other agents during that turn, no matter what the roll of the dice.

Upon reaching a target site and declaring the mission, the player replaces the agent piece with either a destruction piece (FIG. 4B) or a document piece (FIG. 4C) to indicate to the other players that the mission has been declared.

During the return trip from a target site with a retrieved secret document, the player must observe the same rules of play with respect to movement of his piece and avoidance of Danger and Forbidden Zones as in movement of his agent piece towards the target site. When the document piece reaches the player's assigned starting point, that mission is deemed completed. The first player to complete all five of his assigned missions wins the game.

Alternatively, a player may deem it strategic not to declare that he has reached one of his target sites, when in fact he has. In such case, he may simply leave his agent piece on the target site and devote succeeding plays to movement of his other pieces. He may "declare" his mission at such later time as he deems most strategically advantageous.

It may occur that a player is unable to determine the location of one or more of his assigned target sites on the board map from the clues on his Mission cards. For each such unknown target site, the player must move one agent piece into the Central Intelligence box on the board at which time, under penalty of the loss of three turns of play, he may refer to the Master List for identification of the target site. After the third successive turn of play has been sacrificed, he may move the agent piece back to the starting point and thereafter commence play as usual. As desired, the player may go to Central Intelligence immediately upon commencement of the play if he cannot determine a target site from the clue on the Mission card, or he may move his agent pieces towards those target sites that he has identified and delay his resort to Central Intelligence to some later time. A player cannot, however, move an agent piece from his starting point without having a specific target site in mind.

The play of the game provides for obstruction of other player's agents on their assigned tasks and interference or delay of the performance of the missions. Thus, if a player's agent piece comes to rest, at the end of its movement, on a space already occupied by another player's piece, the later arriving player may immediately roll the dice again. If he rolls a double, i.e., the same number of spots on the upturned faces of both of the dice, the agent of the other player must return to its starting point and begin his journey anew. If he does not roll a double, the earlier arriving player, on his next turn, has the opportunity to send the later arriving player's piece back to its starting point by rolling a double. If he does not roll a double, the earlier arriving player simply moves his piece the number of spaces indicated by the dice.

Two agents of the same player may occupy the same space on the map, except for spaces in which target sites are located, and, of course, Forbidden and assigned Danger Zones. When two agents of the same player occupy the same space, an opposing player is not permitted to land on that occupied space and they cannot be sent back to home base.

A player also has the opportunity to impede or delay the performance of an announced mission of an opposing player. Thus, if a player lands his agent exactly on a target site at which an opponent has declared his mission to destroy a missile site, the later arriving player, if he rolls a "seven" or "eleven" on his succeeding turns, before the party whose mission is to destroy the target site does, the latter must return his agent to his starting point and begin the journey again.

In the case of the retrieval of secret documents, an opposing player may interrupt the mission by landing, on an exact roll, on the same space occupied by the returning document piece and, if he then rolls a "double" while both pieces are in the same space, he thereby nullifys the mission accomplished by the player and he must return him to the starting point to begin anew.

Thus, in addition to the benefits derived from knowledge of geography and the element of chance inherent in rolling of the dice, a player may improve his position and chances of winning by strategic movement of his pieces across the board. He may postpone declaring that he has reached the target site, so as to avoid possible interference by an opponent, or he may direct his own moves with a view to interfering with the performance of an opponent's mission, as he deems desirable, all of which contribute to the excitement and entertainment afforded by the game.

By way of example, there are tabulated below the clues appearing on one set of Mission cards employed in the preferred embodiment, relating to the 48 target sites indicated on the board map of FIG. 1, along with the complete identification of the target sites included in the Master list, followed by a tabulation of the contents of the Danger Zone cards. It will be appreciated that play of the game will reinforce a player's knowledge of geography or educate him in those areas in which he is lacking in a painless, entertaining fashion.

| | MISSION CARD TARGET SITE CLUES | MASTER LIST IDENTIFICATION |
|---|---|---|
| 1. | Small Middle East country; highest income per person in the world; on the Persian Gulf. | Kuwait - 30° N. Lat., 48° E. Long. |
| 2. | On important strait, the Dardanelles. Long sought by Russia. Large Moslem population. Country produces high quality tobacco. City once was named for Roman emperor. | Istanbul 41° N. Lat., 29° E. Long. |
| 3. | On Scandanavian peninsula; coastline of fiords; "midnight sun" in the north. City is the capital. | Oslo, Norway 60° N. Lat., 10° E. Long. |
| 4. | State capital; crossroads of east-west ocean shipping and air routes, Tourists, pineapples, and sugar are big business. Pearl Harbor near city. | Honolulu 21° N. Lat., 158° W. Long. |
| 5. | 7° N. Lat., 80° E. Long. | Sri Lanka 7° N. Lat., 80° E. Long. |
| 6. | 35° N. Lat., 77° E. Long. | Kashmir 35° N. Lat., 77° E. Long. |
| 7. | Chinese city; near the Great Wall; seat of Communist government. | Peking, China 40° N. Lat., 115° E. Long. |
| 8. | One of world's most important man-made waterways. Often closed in wars involving Arab States. | Suez Canal 30° N. Lat., 32° E. Long. |
| 9. | 16° S. Lat., 48° W. Long. | Brasilia, Brazil 16° S. Lat., 48° W. Long. |
| 10. | 20° N. Lat., 100° W. Long. | Mexico City 20° N. Lat., 100° W. Long. |
| 11. | Capital of olive and wine-producing country, loved by American tourists. City founded on seven hills. Last king of country was Victor Emmanuel. Roman Catholic is official state religion. | Rome 40° N. Lat., 12° E. Long. |
| 12. | Man-made waterway connects two oceans; built by United States engineers across an isthmus. | Panama Canal 9° N. Lat., 80° W. Long. |
| 13. | Capital of country with snow-capped mountains, volcanoes; exporter of wool; largest exporter of meat (lamb); Pacific ally of Australia | Wellington, New Zealand 41° S. Lat., 175° E. Long. |
| 14. | Site of 1962 World's Fair; "jumping-off" place for Alaskan gold-seekers in 1897; major port on Puget Sound. | Seattle 48° N. Lat., 122° W. Long. |
| 15. | 13° N. Lat., 145° E. Long. | Guam 13° N. Lat., 145° E. Long. |
| 16. | Capital of Communist country. "Discovered" by Columbus; once belonged to Spain. Called "The Pearl of the Antilles." | Havana, Cuba 23° N. Lat., 82° W. Long. |
| 17. | 38° N. Lat., 90° W. Long. | St. Louis 38° N. Lat., 90° W. Long. |
| 18. | 2° S. Lat., 37° E. Long. | Nairobi, Kenya 2° S. Lat., 37° E. Long. |
| 19. | French-speaking city founded in 1608; near mouth of a river that flows north; old city is on a cliff above the river. | Quebec, Canada 46° N. Lat., 72° W. Long. |
| 20. | Holy city of the Mongols and now capital of the republic. Home of Mongol princes. Homeland of ancient warriors on horseback. Under control of Russians several times. Capital of independent country since 1924. | Ulan Bator, Mongolia 48° N. Lat., 107° E. Long. |
| 21. | 6° S. Lat., 107° E. Long. | Jakarta, Indonesia 6° S. Lat., 107° E. Long. |
| 22. | 62° N. Lat., 70° W. Long. | Hudson Strait 62° N. Lat., 70° W. Long. |
| 23. | 15° N. Lat., 121° E. Long. | Manila, Philippines 15° N. Lat., 121° E. Long. |
| 24. | Capital of country independent since 1960; western coast of the continent. 80% of people are Moslem. French influence on land. Important seaport for export of phosphates. | Dakar, Senegal 15° N. Lat., 17° W. Long. |
| 25. | Capital city of its country, on the banks of the Rio de la Plata; Country has more cattle and sheep than people. Treeless pampas is great farming region. | Buenos Aires, Argentina 35° S. Lat., 58° W. Long. |
| 26. | 11° N. Lat., 67° W. Long. | Caracas, Venezuela 11° N. Lat., 67° W. Long. |
| 27. | 20° S. Lat., 58° E. Long. | Mauritius 20° S. Lat., 58° E. Long. |
| 28. | Northern ice-free port when | Murmansk, Soviet Union |

-continued

| MISSION CARD TARGET SITE CLUES | MASTER LIST IDENTIFICATION |
|---|---|
| ports farther south are ice-bound. Port for convoys from Britain and United States feeding supplies to Soviet Union in World War II. Fishing port; large canneries. | 69° N. Lat., 33° E. Long. |
| 29. 360 mile-long strait, narrow and risky. Not of great importance in trade-away from major trade routes. Located by explorers from Spain in 1520. Sailors wrote of "eternal cold" to the south. Temperature averages 33° to 50° throughout the year. | Strait of Magellan 53° S. Lat., 69° W. Long. |
| 30. 55° N. Lat., 83° E. Long. | Novosibirsk, Soviet Union 55° N. Lat., 83° E. Long. |
| 31. Uru Indians live on man-made islands in this lake. Culture of Urus is older than Incas. Other Indians near lake are farmers or work in the tin mines of this land named for Simon Bolivar. | Lake Titicaca 16° S. Lat., 69° W. Long. |
| 32. Capital city of country where "apartheid" (separation of races) is a tradition. Bantus are largest group in population. Most other nations on the continent oppose its policies. Has a Mediterranean climate. | Capetown, South Africa 35° S. Lat., 18° E. Long. |
| 33. Capital and seaport city in western part of continent - in rainforest region. Exports of cocoa, palm oil and peanuts. 250 tribes live in the country; the Hausa are most important. Capital of country independent since 1960. | Lagos, Nigeria 5° N. Lat., 4° E. Long. |
| 34. Seat of government of a 14-island archipelago. Part of islands have a United States governor. 1600 miles from nearest large group. Discovered by Dutch sailors; people are Polynesian. Good harbor. Pictured in movies as an exotic island. | Pago Pago, Samoa 14° S. Lat., 171° W. Long. |
| 35. City of 700,000 enjoys a Mediterranean climate. Water from artesian wells. Land nearby is dry and desolate. Sheep-raising is chief occupation of those in dry area. Country originally settled by English prisoners. Only city in western part of continent. | Perth, Australia 32° S. Lat., 116° E. Long. |
| 36. 60° N. Lat., 30° E. Long. | Leningrad, Soviet Union 60° N. Lat., 30° E. Long. |
| 37. Largest city in its state. "Movie" industry helped its growth. Mediterranean climate. Jokes on the city when it rains. Citrus fruits, grapes, vegetables in fertile valleys near city. | Los Angeles 34° N. Lat., 118° W. Long. |
| 38. Island is often associated with Northern Europe. Became free from Denmark in 1944. Language developed from settlers from Norway in 10th century. Visited by Vikings. Krona is the unit of money. | Iceland 64° N. Lat., 20° W. Long. |
| 39. Sometimes known as "The Rock;" guards one of the world's most important straits, 36 miles long. A colony of Great Britain; largely British population-some from Africa. No railroads. Import nearly all food and goods. | Rock of Gibraltar 36° N. Lat., 5° W. Long. |
| 40. One of world's largest and most important cities. Famous for Red Square and tomb of Lenin. Largest Standing army in the world; leader in space exploration. | Moscow 56° N. Lat., 38° E. Long. |

-continued

| MISSION CARD TARGET SITE CLUES | MASTER LIST IDENTIFICATION |
|---|---|
| 41. Islands held by United States since 1867. Once regular stop on airline route from San Francisco to Manila. Lesser importance now. Islands but two square miles in area. Naval battle here was turning point of war in Pacific in 1942. | Midway Islands 28° N. Lat., 177° W. Long. |
| 42. Capital of largest island in the world, owned by Denmark. No railroads; only 90 miles of roads. No daily newspaper; most people live in villages in southern part. | Greenland 64° N. Lat., 51° W. Long. |
| 43. Island 600 miles north of St. Helena where Napolean was exiled. British-owned. Only 34 square miles in area. Discovered by Portuguese. Winds blow across barren land from east. Now a tracking station for United States space flights. | Ascension Island 8° S. Lat., 14° W. Long. |
| 44. City on world's largest inland sea - larger than all of Japanese islands. Caucasus Mountains lie to the west; oil and gas are most important resources of the region. | Baku (on Caspian Sea) 41° N. Lat., 50° E. Long. |
| 45. Once a Hudson Bay trading post. Railroad and airline center on the prairie. Capital of Alberta Province on the Saskatchewan River. | Edmonton, Canada 54° N. Lat., 114° W. Long. |
| 46. 27° S. Lat., 109° W. Long. | Easter Island 27° S. Lat., 109° W. Long. |
| 47. 36° N. Lat., 140° E. Long. | Tokyo 36° N. Lat., 140° E. Long. |
| 48. Small archipelago with tropical fruits, plants, woods. Dense forests in southeast. Once home of cannibals. Many Indians in population. Explored in turn by Tasman, Cook and Lt. Bligh in "The Bounty." Independent from Britain since 1970. | Fiji Islands 15–20° S. Lat., 179 E. Long. |

| DANGER ZONES | |
|---|---|
| HURRICANE, Gulf of Mexico | From 20° to 30° N., 85° to 95° W. |
| AIR-SEA RESCUE OPERATIONS South Pacific Ocean | From 5° to 20° S., 125° to 140° W. |
| TORNADOES, mid-United States | From 35° to 45° N., 90° to 100° W. |
| ICE BERGS, off Greenland | From 55° to 65° N., 30° to 50° W. |
| TIDAL WAVE, off India, Pakistan | From 10° to 25° N., 65° to 75° E. |
| SPACECRAFT RE-ENTRY ZONE, Pacific | From 10° to 25° N., 135° to 150° W. |
| SNOW STORM - Alps | From 45° to 50° N., 5° to 20° E. |
| AIR-SEA RESCUE OPERATIONS, Indian Ocean | From 20° to 35° S., 70° to 90° E. |
| HURRICANE - Caribbean Sea, Atlantic | From 10° to 30° N., 55° to 65° W. |
| AIR-SEA RESCUE OPERATIONS South Atlantic Ocean | From 10° to 20° S., 5° to 25° W. |
| STORMS AT SEA, Pacific Ocean | From 40° to 50° N., 135° to 150° W. |
| TYPHOON, South China Sea | From 5° to 20° N., 110° to 120° E. |
| WINTER SNOW AND ICE, Hudson Bay | From 55° to 65° N., 75° to 95° W. |
| WINTER SNOWS, Siberia | From 55° to 70° N., 60° to 80° E. |
| TYPHOON, Philippine Sea | From 10° to 30° N., 130° to 140° E. |

It will be realized that the equipment included in the preferred form of the game may include three or more sets of Mission cards identifying the same target site by different clues and that target sites and Danger Zones other than those delineated above may be employed.

Moreover, it will be clear that many variations in the rules of play are possible employing the same apparatus, without departing from the general principles of play described above.

We claim:

1. Game apparatus for play by two or more players, comprising:

a game board on which is imprinted an unlegended map of at least a portion of the earth's surface, including latitude parallels and longitude meridians at intervals of predetermined indicated degree spacing dividing said map into spaces formed by the intersection of said latitude parallels and longitudinal meridians, and a plurality of indicia on said map designating unidentified preselected target sites within respective ones of said spaces and representing real locations on the earth's surface, a first plurality of mission cards, each of which bears a written clue to the identity of one of said preselected target sites and the nature of a mission to be performed thereat, for distribution of one or more to each of the players at commencement of play, a plurality of playing pieces for each player, one for each mission card distributed to a player, each of said pieces being employed to designate movement of the player from a starting point to a preselected target site, and means for randomly governing movement of said playing pieces along paths comprised of the spaces formed by intersection of successive latitude parallels and longitude meridians.

2. The game apparatus of claim 1 wherein said means for randomly governing movement of said playing pieces comprises a pair of dice.

3. The game apparatus of claim 1, wherein said game board further includes indicia identifying a first plurality of forbidden zones through which movement of playing pieces of all players is prohibited.

4. The game apparatus of claim 3 further comprising:

indicia on said game board identifying a plurality of danger zones, different from said forbidden zones, and a plurality of danger zone cards identifying said danger zones, for random distribution to each of said players, movement of a player being prohibited through the ones of said danger zones identified by the danger cards received by him.

5. The game apparatus of claim 4 further including additional playing pieces for designating those of the danger zones respectively associated with each player.

6. The game apparatus of claim 1 wherein there is provided a plurality of sets of playing pieces for each player, one set for each mission card distributed to a player, each of said sets including at least one of said pieces employed to designate movement of the player from a starting point to a target site, and a second piece different in form from said one of said pieces, said second piece being employed to designate arrival of the player at a target site and to identify the nature of the mission to be performed at that site.

7. The game apparatus of claim 1 further comprising means fully identifying each of said target sites to which the clues on said mission cards are directed, and which may be availed of by a player upon prescribed penalty.

8. The game apparatus of claim 1 wherein there are provided a plurality of sets of mission cards, each set bearing written clues to the identity of said target sites, the clues in each of said sets of mission cards presenting a different degree of difficulty in identifying the target sites than the other sets.

9. Game apparatus for play by two or more players, comprising:

a game board on which is imprinted an unlegended map of at least a portion of the earth's surface, including latitude parallels and longitude meridians at intervals of predetermined indicated degree spacing dividing said map into spaces formed by the intersection of said latitude parallels and longitudinal meridans, said board further including a plurality of first indicia on said map designating unidentified preselected target sites representing real locations on the earth's surface, each of said target indicia being located within the one of said spaces on said map corresponding to its real location, a plurality of second indicia covering predetermined areas of said map and which designate forbidden zones corresponding in location to areas on the earth's surface which are considered virtually impassable; and a plurality of third indicia visually distinguishable from said second indicia covering predetermined areas of said map different from said second indicia and which designate a plurality of danger zones corresponding in location to areas on the earth's surface which are hazardous to passage, a first plurality of mission cards, each of which bears a written clue to the identity of one of said preselected target sites and the nature of a mission to be performed thereat, for distribution of one or more to each of the players at the commencement of play, a plurality of danger zone cards, each of which identifies one of said danger zones, a plurality of playing pieces for each player, one for each mission card distributed to a player, each of said pieces being employed to designate movement of the player from a starting point to a preselected target site, a plurality of danger zone indicating pieces, each adapted to be placed in one of said danger zones to indicate the relationship of a player to said danger zone, and means for randomly governing movement of said playing pieces along paths comprised of the spaces formed by the intersection of said latitude parallels and longitude meridians.

* * * * *